United States Patent [19]

Hatano et al.

[11] Patent Number: 5,068,049

[45] Date of Patent: Nov. 26, 1991

[54] METHOD OF COLD ROLLING A METAL

[75] Inventors: Tsutomu Hatano; Sohei Kawasaki; Tetsuro Hoshino, all of Tokyo; Takamitsu Endo, Yokahama, all of Japan

[73] Assignee: Exxon Research & Engineering Company, Florham Park, N.J.

[21] Appl. No.: 138,938

[22] Filed: Dec. 29, 1987

[51] Int. Cl.[5] ..... C10M 129/72

[52] U.S. Cl. ..... 252/57; 252/56 R; 72/42

[58] Field of Search ..... 252/56 S, 56 R, 56 D, 252/57; 72/42

[56] References Cited

U.S. PATENT DOCUMENTS

| | | | |
|---|---|---|---|
| 2,134,736 | 4/1935 | Reuter | 252/56 D |
| 3,019,188 | 1/1962 | Craven et al. | 252/57 |
| 3,947,369 | 3/1976 | Leibfried | 252/57 |
| 4,589,990 | 5/1986 | Zehler et al. | 252/56 |
| 4,640,819 | 2/1987 | Balding et al. | 422/22 |
| 4,765,917 | 8/1988 | Otaki et al. | 252/49.3 |
| 4,790,957 | 12/1988 | Mach et al. | 252/57 |

FOREIGN PATENT DOCUMENTS

| | | |
|---|---|---|
| 0157583 | 3/1985 | European Pat. Off. . |
| 1481270 | 7/1977 | United Kingdom . |

*Primary Examiner*—Prince E. Willis
*Assistant Examiner*—Ellen M. McAvoy
*Attorney, Agent, or Firm*—John W. Ditsler

[57] ABSTRACT

The present invention relates to a metal-working lubricating oil having improved lubricity due to the addition of certain tri-esters of tri-mellitic acid to said oil. The oil thus formed is particularly well suited as roll oil lubricant in the cold rolling of stainless sheets and foil.

8 Claims, 5 Drawing Sheets

METHOD OF COLD ROLLING A METAL

BACKGROUND OF THE INVENTION

1. Field of the Invention

The present invention relates to a metal working lubricating oil having improved lubrication properties due to the addition of certain esters of trimellitic acid to said oil.

2. Description of Related Art

The use of esters in lubricating oils is known. For example, U.S. Pat. No. 2,134,736 discloses that esters of polybasic carboxylic acids, particularly dibasic carboxylic acids, when admixed with hydrocarbon oils, are of special utility in extreme pressure lubrication applications; e.g. gear and bearing oils, metal cutting and boring oils, etc. As another example, U.S. Pat. No. 3,769,215 discloses ester lubricant compositions in which the esters are derived from polyoxyalkaline glycols with dibasic acid mixture consisting of dimer acids and shortchained dibasic acids. In yet another example, U.S. Pat. No. 4,178,260 discloses ester based metalworking lubricants in which preferred lubricants comprise a mixture of (i) tetraester of pentaerythritol and a $C_6$–$C_{20}$ aliphatic monocarboxylic acid, and (ii) orthophosphoric acid. Finally, U.S. Pat. Nos. 4,618,441 and 4,655,947 disclose a lubricant composition comprising a mineral oil and an alkoxyalkyl ester.

However, none of the foregoing references mention a lubricating oil having improved lubricity due to the presence of tri-2-ethylhexyl-trimellitate, tri-normal-octyl-trimellitate or mixtures thereof in said oil.

SUMMARY OF THE INVENTION

Now according to the present invention, it has been discovered that a metalworking lubricating oil containing a minor amount of tri-2-ethylhexyltrimellitate (TOTM), tri-normal-octyl-trimellitate (TNOTM) or mixtures thereof has improved lubricity and brightness relative to that obtained if TOTM or TNOTM were not present in said oil. The present invention also contemplates an improved metalworking method which comprises performing a metalworking operation using a lubricating oil containing a minor amount of TOTM, TNOTM or their mixtures.

DETAILED DESCRIPTION OF THE INVENTION

Figure 1:
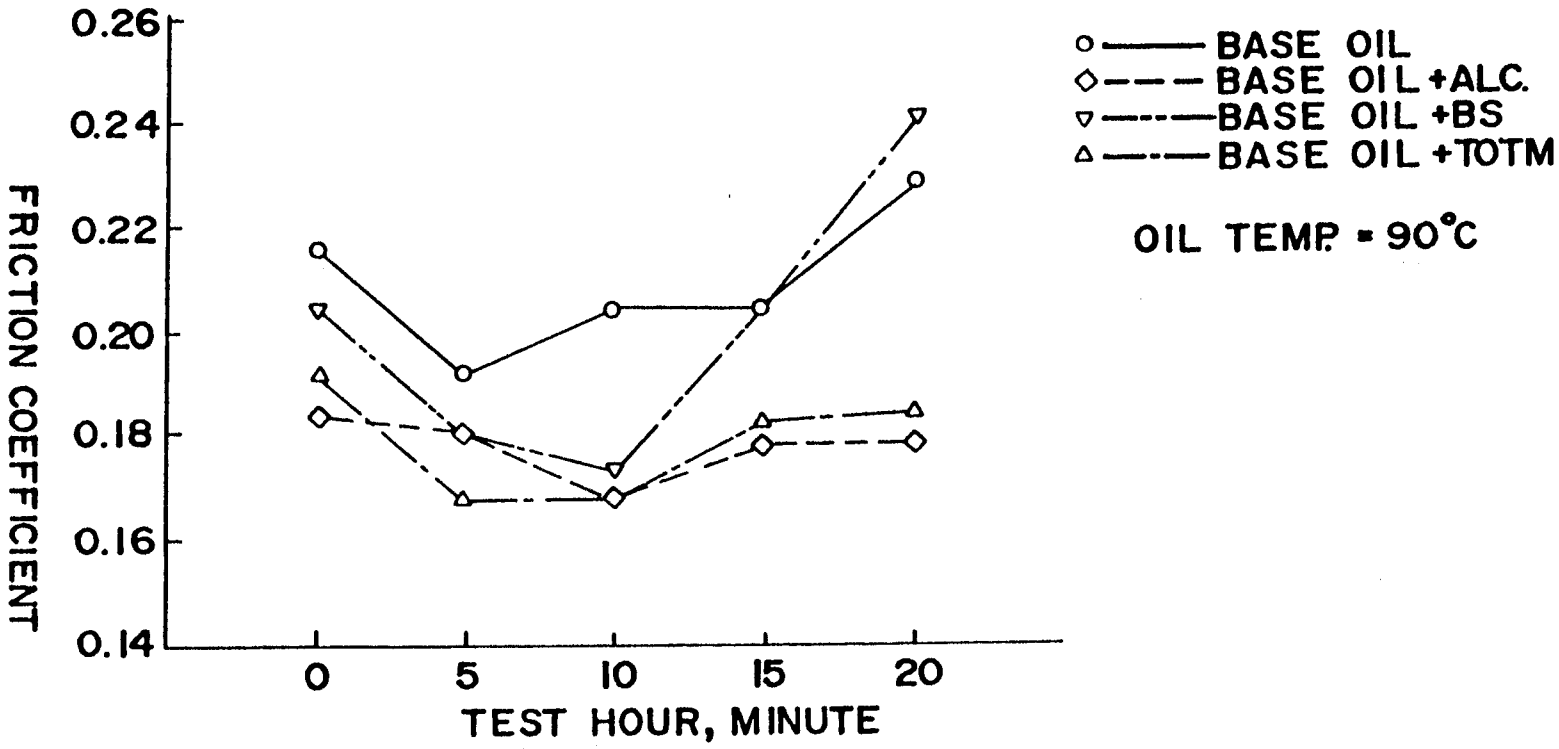
FIGS. 1–3 show the variation in friction coefficient with time for a base oil, alone and in combination with various additives, at three temperatures.

The metalworking lubricating oil to which TOTM or TNOTM is added will comprise a major amount of a lubricating basestock (or base oil) and a minor amount of TOTM or TNOTM. The basestock may include liquid hydrocarbons such as mineral lubricating oils, synthetic lubricating oils or mixtures thereof. It is important that the basestock contain minor amounts of aromatics (e.g. from about 4 to about 10 wt. %, preferably from about 5.5 to about 8 wt. %) and have a saponification number from about 15 to about 40, preferably from about 20 to about 35 and more preferably from about 25 to about 30. A preferred basestock is a paraffin distillate that has been solvent extracted and hydrofined such that the sulfur level range from about 0.1 to about 0.5 wt. %. Typically, the base oil viscosity will range from about 8 to about 20, preferably from about 9 to about 15, cSt at 40° C.

The amount of TOTM or TNOTM present in said metalworking lubricating oil will vary depending upon the degree of brightness desired, the specific operating parameters used and the specific applications of the oil. In general, the amount need only be that which is sufficient or effective to impart improved brightness to said oil while remaining soluble therein. Typically, however, the amount will range from about 8 to about 15 wt. %, preferably from about 10 to about 13 wt. %, of said lubricating oil. TOTM and TNOTM are commercially available compounds and can be prepared by known reactions.

In addition to TOTM or TNOTM, other additives known in the art may be included in said lubricating oil if desired. For example, an oxidation inhibitor could be added to improve the oxidation stability of said oil.

The lubricating oil of the present invention is suitable for use in metalworking applications when metal surfaces are rubbing against each other. The oil has particular application as a lubricant during the cold rolling of metal sheets and foils, especially stainless steel sheets and foils. When the oil is used in such applications, there results an improved brightness of the metal and a reduction in friction between the rubbing metals being lubricated. The roughness of the rolled metal is also minimized. Typically, the oil will have a viscosity ranging from about 8 to about 20 cSt at 40° C.

Although the oil of the present invention has been described with respect to the use of TOTM and its isomer TNOTM, certain homologues of said compounds may also be suitably employed in said oil. As such, the class of tri-esters which can be used will have the general formula:

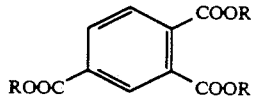

wherein R is an alkyl group having from 6 to 13 carbon atoms; e.g. tri-normal-nonyl-trimellitate ($C_9$), tri-isodecyl-trimellitate ($C_{10}$) and the like. However, TOTM or TNOTM (in which R is 8 carbon atoms) is preferred.

The present invention may be further understood by reference to the following examples which are not intended to restrict the scope of the claims appended hereto.

EXAMPLE 1

Effect of TOTM on Friction Coefficient

Tests were performed on 30 cc samples of a base oil, alone and in combination with certain additives, using a Ball-on-Cylinder machine to determine the effect of said additives on the coefficient of friction. The machine used is described by R. Benzing, et al in Friction and Wear Devices, Second Edition, American Society of Lubricating Engineers (1976), the disclosure of which is incorporated herein by reference. The machine was operated at room air with a 4 kg load being applied for about 20 minutes at three temperatures (90°, 120° and 150° C.) while the cylinder was rotated at 0.8 rpm (11.3 cm/min). The metallurgy was 52,100 stainless steel (SUJ-2) for both the ball (1.25 cm in diameter) and the rotating cylinder (46 mm×18 mm). The ball and cylinder had a surface roughness of 2 and 6 micro inches, respectively. The Rockwel hardness of the cylinder was 62. The base oil tested had the following specifications:

| | |
|---|---|
| Aromatics, wt. % | 5.6 |
| Viscosity, cSt at 40° C. | 9.5 |
| Sulfur, wt. % | 0.2 |

The base oil plus additives tested were as follows:

Base oil+10 wt. % $C_{12}$/C16 alcohol

Base oil+10 wt. % C18 butyl stearate

Base Oil+10 wt. % TOTM

The saponification number of the base oil/TOTM mixture was 30.

Figure 2:
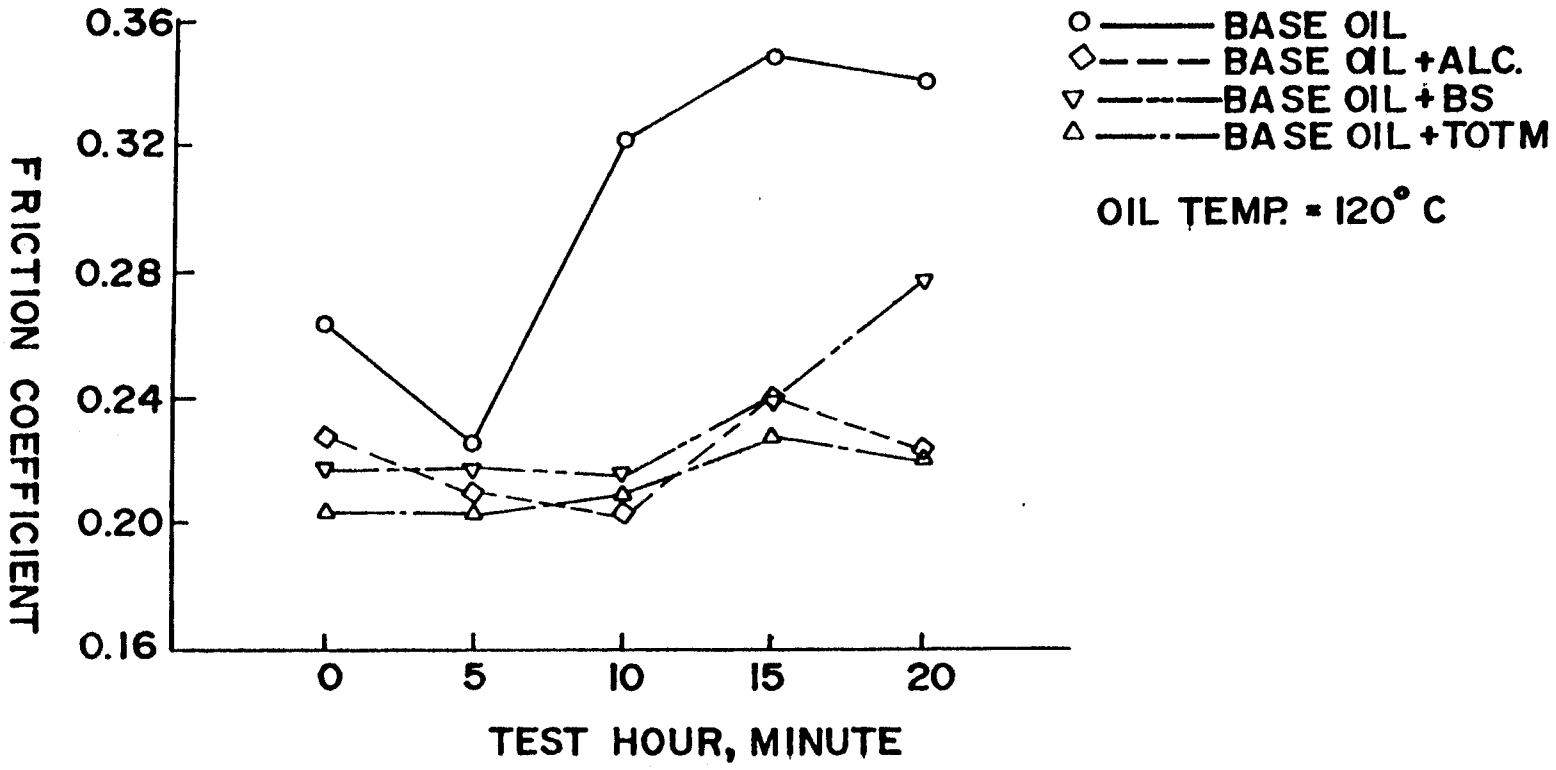
Figure 3:
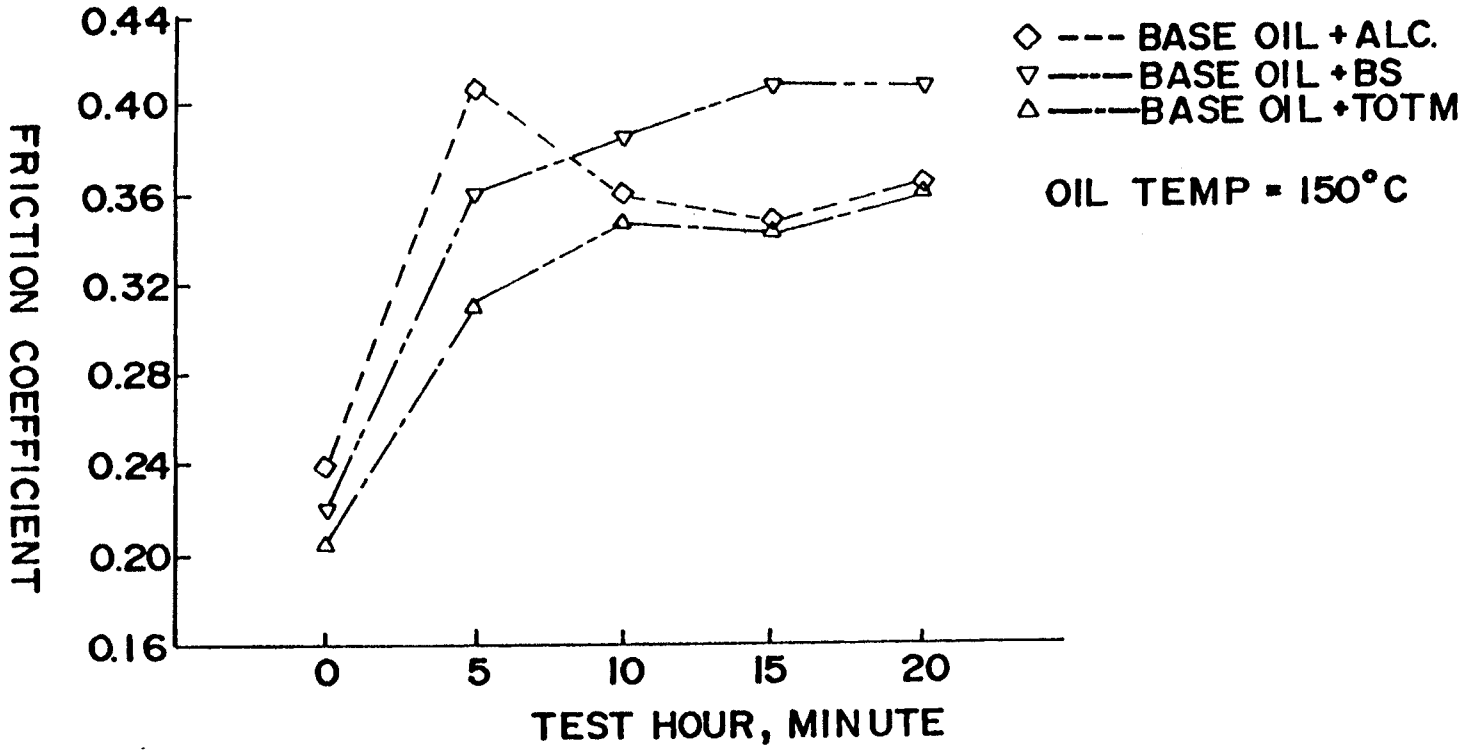

The results of these tests are summarized in Table 1 below and shown in FIGS. 1, 2 and 3.

TABLE 1

| Temperature | 0 min | 5 min | 10 min | 15 min | 20 min |
|---|---|---|---|---|---|
| 90° C. | | | | | |
| Base oil | 0.216 | 0.102 | 0.204 | 0.204 | 0.228 |
| Plus alcohol | 0.184 | 0.180 | 0.168 | 0.178 | 0.178 |
| Plus B. stearate | 0.204 | 0.180 | 0.173 | 0.204 | 0.240 |
| Plus TOTM | 0.192 | 0.168 | 0.168 | 0.182 | 0.184 |
| 120° C. | | | | | |
| Base oil | 0.264 | 0.226 | 0.322 | 0.349 | 0.341 |
| Plus alcohol | 0.228 | 0.211 | 0.204 | 0.240 | 0.224 |
| Plus B. stearate | 0.217 | 0.217 | 0.214 | 0.238 | 0.277 |
| Plus TOTM | 0.204 | 0.204 | 0.209 | 0.228 | 0.220 |
| 150° C. | | | | | |
| Base oil | (1) | (1) | (1) | (1) | (1) |
| Plus alcohol | 0.240 | 0.408 | 0.360 | 0.349 | 0.365 |
| Plus B. stearate | 0.217 | 0.360 | 0.385 | 0.409 | 0.409 |
| Plus TOTM | 0.204 | 0.312 | 0.348 | 0.343 | 0.360 |

(1) Cannot be measured.

The data in Table 1 show that a lower coefficient of friction is obtained with increasing temperature when the base oil contains TOTM.

EXAMPLE 2

Effect of TOTM on Brightness

A test was performed in a 12 stage multi-roller mill manufactured by Sundwig using a 304 stainless steel (Austinite) annealed sample 0.9 mm thick, 150 mm wide and 100 mm long. The work roll was stainless steel (SUJ-2) and 38 mm in diameter with a Vickers hardness of 950 and a roughness of 0.3 micron meter. The rolling speed ranged from 20 to 200 m/min. The properties of the oils tested were as follows:

| Properties | Oil A | Oil B |
|---|---|---|
| Viscosity, cSt at 40° C. | 10 | 10 |
| Additive, wt. % | 10 | 13–14 |
| Primary | TOTM | Mono-Ester |
| Booster | — | Phosphate(TCP) |
| Saponification No. | 30 | 40 |

The brightness was then determined for each sample and the results summarized below in Table 2 and shown in FIG. 4.

TABLE 2

| Rolling Speed (m/min) | Brightness Oil A | Brightness Oil B |
|---|---|---|
| 20 | 979 | 1001 |
| 50 | 1027 | 991 |
| 100 | 1034 | 968 |
| 130 | 1035 | 980 |
| 200 | 1012 | 938 |

Figure 4:
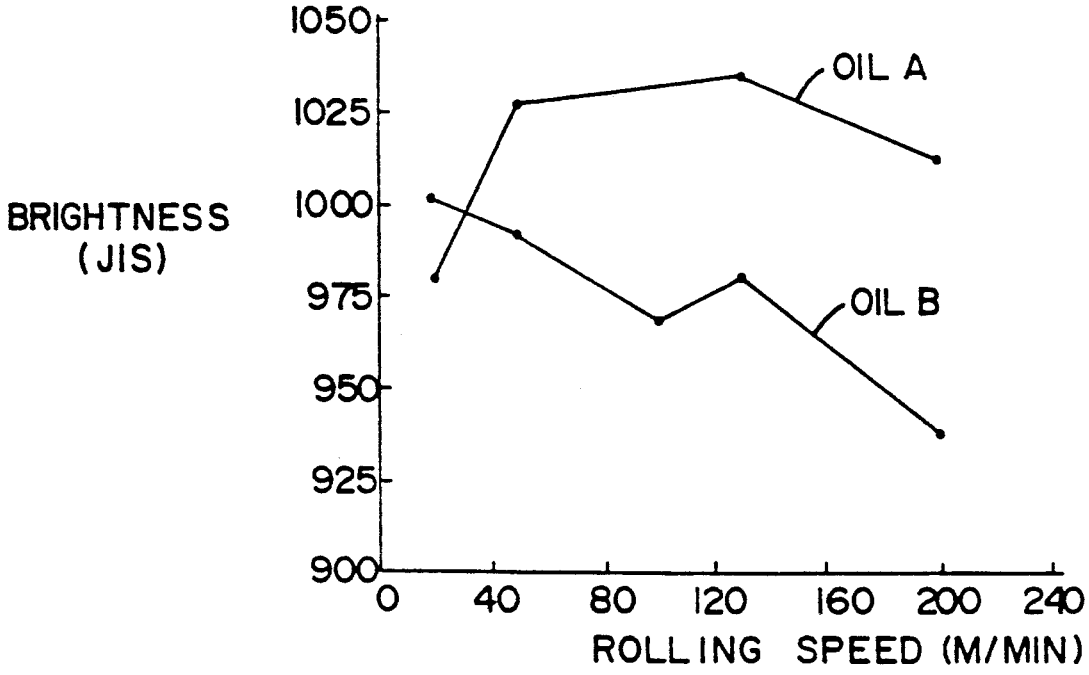
FIG. 4 shows the variation in brightness with rolling speed for two different oils.

The data in Table 2 as illustrated in FIG. 4 show that the brightness of the sample is improved when the oil contains TOTM. Thus, the use of TOTM results in a better surface finish than competitive additives.

EXAMPLE 3

Effect of TNOTM on Brightness

A test was performed in a 12 stage multi-roller mill manufactured by Kobelco using a 430 stainless steel (Ferrite) annealed sample 0.1 mm thick, 50 mm wide and 100 mm long. The work roll was stainless steel (SUJ-2) with a Vickers hardness of 98 and a roughness of 0.3 micron meters. The rolling speed was 100 m/min. Tests were performed at rolling reduction ranging from 40 to 65% using oils having the following properties:

| Properties | Oil A | Oil B | Oil C |
|---|---|---|---|
| Viscosity, cSt at 40° C. | 8.0 | 8.0 | 8.0 |
| Additive, wt. % | 10 | 20 | 20 |
| Primary | TNOTM | Mono-Ester | Mono-Ester |
| Booster | — | Phosphate(TCP) | Fatty Acid |
| Saponification No. | 30 | 40 | 40 |

Figure 5:
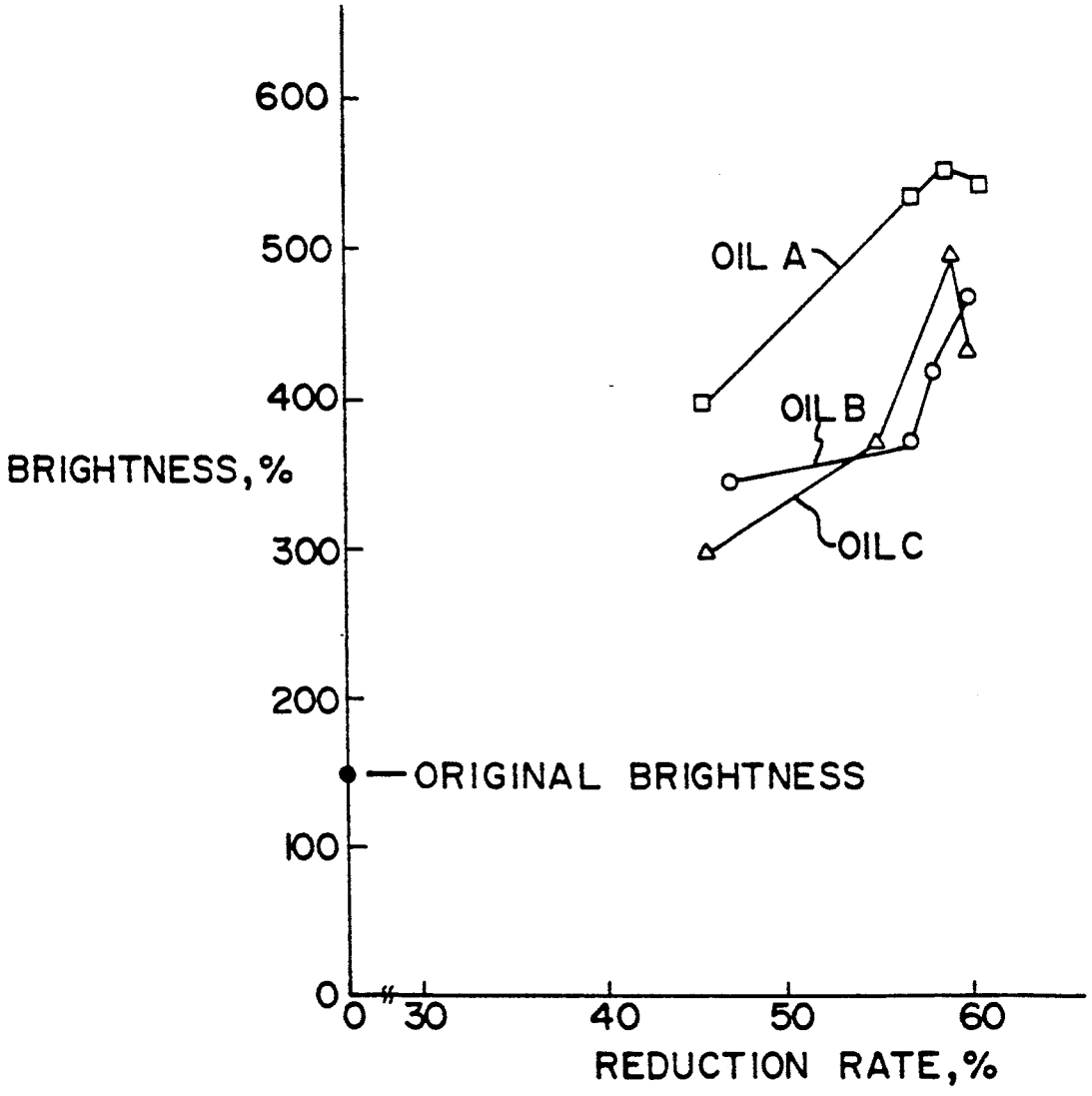
FIG. 5 shows the variation in % brightness with reduction rate for three different oils.

The results of these tests are shown in FIG. 5.

The data in FIG. 5 show that the brightness is improved and a better surface finish is obtained when an oil containing TNOTM (without the addition of any brightness enhancers) is used.

What is claimed is:

1. A method of cold rolling a metal which comprises (a) applying to a metal a lubricant composition comprising a major amount of a lubricating oil basestock and from about 8 to about 15 wt. % of a tri-ester having the general formula

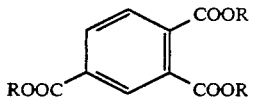

wherein R is an alkyl group having from 6 to 13 carbon atoms, and (b) performing a cold rolling operation on said metal.

2. The method of claim 1 wherein said tri-ester is tri-2-ethylhexyl-trimellitate, tri-normal-octyl-trimellitate or mixtures thereof.

3. The method of claim 2 wherein said basestock has an aromatics content ranging from about 4 to about 10 wt. %.

4. The method of claim 1 wherein from about 10 to about 13 wt. % of said tri-ester is present.

5. The method of claim 1 wherein said metal is stainless steel.

6. The method of claim 5 wherein said metal is a stainless steel sheet.

7. The method of claim 1 wherein the said tri-ester is tri-2-ethylhexyl-trimellitate.

8. The method of claim 1 wherein said tri-ester is tri-normal-octyl-trimellitate.

* * * * *